United States Patent [19]

Kashio

[11] 4,419,919

[45] Dec. 13, 1983

[54] ELECTRONIC MUSICAL INSTRUMENT

[75] Inventor: Toshio Kashio, Tokyo, Japan

[73] Assignee: Casio Computer Co., Ltd., Tokyo, Japan

[21] Appl. No.: 274,717

[22] Filed: Jun. 18, 1981

Related U.S. Application Data

[63] Continuation of Ser. No. 74,416, Sep. 11, 1979, abandoned.

[30] Foreign Application Priority Data

Sep. 14, 1978 [JP] Japan ..... 53-113000
Sep. 14, 1978 [JP] Japan ..... 53-113001
Dec. 27, 1978 [JP] Japan ..... 53-164864

[51] Int. Cl.[3] ..... G10H 1/02; G10H 1/46; G10H 7/00

[52] U.S. Cl. ..... 84/1.27; 84/1.19; 84/1.24; 84/1.25; 84/DIG. 9

[58] Field of Search ..... 84/1.01, 1.03, 1.11, 84/1.19, 1.21–1.27, DIG. 9

[56] References Cited

U.S. PATENT DOCUMENTS 3,636,231 1/1972 Schrecongost et al. .
3,668,294 6/1972 Kameoka et al. ..... 84/1.01
3,757,022 9/1973 Markowitz ..... 84/1.25
3,816,637 6/1974 Whitefield ..... 84/1.24
3,882,751 5/1975 Tomisawa et al. ..... 84/1.01
4,067,253 1/1978 Wheelwright et al. ..... 84/1.24 X
4,077,294 3/1978 Hiyoshi et al. ..... 84/1.24 X
4,103,242 7/1978 Shigeta .
4,111,092 9/1978 Adachi ..... 84/1.27
4,119,005 10/1978 Kondo et al. ..... 84/1.01
4,128,032 12/1978 Wada et al. .
4,176,577 12/1979 Yamada et al. ..... 84/1.01
4,179,972 12/1979 Hiyoshi et al. .
4,201,105 5/1980 Alles ..... 84/1.01
4,213,366 7/1980 Niimi et al. .
4,253,367 3/1981 Hiyoshi et al. .

FOREIGN PATENT DOCUMENTS 2237594 2/1973 Fed. Rep. of Germany .
2800858 7/1978 Fed. Rep. of Germany .
2808283 9/1978 Fed. Rep. of Germany .
2329101 5/1977 France .
1237684 6/1967 United Kingdom .
1335953 10/1973 United Kingdom .
1529057 10/1974 United Kingdom .
1395376 5/1975 United Kingdom .
1409763 10/1975 United Kingdom .
1506671 4/1978 United Kingdom .
1541305 2/1979 United Kingdom .
1549045 7/1979 United Kingdom .

*Primary Examiner*—S. J. Witkowski
*Attorney, Agent, or Firm*—Frishauf, Holtz, Goodman & Woodward

[57] ABSTRACT

An electronic musical instrument comprises a plurality of musical tone control units each having a tone waveform producing circuit, a volume envelope circuit, a filter circuit and other circuits. A given musical tone data can be preset in each musical tone control unit. Musical tone signals produced by the musical tone control units are synthesized to provide an effective musical tone.

7 Claims, 9 Drawing Figures

ELECTRONIC MUSICAL INSTRUMENT

This is a continuation of application Ser. No. 74,416 filed Sept. 11, 1979, and now abandoned.

BACKGROUND OF THE INVENTION

This invention relates to a digital electronic musical instrument which is provided with a plurality of musical tone control means and which synthesizes musical tone signals produced by the musical tone control means to provide a musical tone.

Various musical tones can be preset in an electronic musical instrument such as an electronic piano and an electronic organ. The player selects desired musical tones from the preset ones, thus playing a tone. The known electronic musical instrument of this type is provided with one digital circuit system, i.e. one musical tone control means which can produce various musical tones.

A musical tone produced by any conventional musical instrument varies very delicately. If a digital electronic musical instrument is to produce a musical tone which varies as much delicately, it requires a much complicated and highly sophisticated control means. In other words, if one musical tone control means is to produce such a delicately changing musical tone, it has to become complicated and difficult to design.

Thus it seems nearly impossible to produce a musical tone by means of one musical tone control means, which is richer and more pleasant than those produced by the electronic musical instrument available at present. An electronic musical instrument which is more simple in system structure and which can yet produce richer and more pleasant musical tones is now strongly desired.

It is an object of this invention to provide a digital electronic musical instrument provided with a plurality of musical tone control means in which various musical tone data are preset and from which various musical tone signals are delivered and with a keyboard including a set of performance keys which are selectively depressed to operate all the musical tone control means, whereby the musical tone signals produced by the musical tone control means are synthesized to provide a rich and pleasant musical tone.

SUMMARY OF THE INVENTION

According to this invention a digital electronic musical instrument is provided, which comprises a keyboard including performance keys, a plurality of musical tone control means in which various musical tone data are digitally preset and from which various musical tone signals are delivered, means for operating all the musical tone control means upon operation of the performance keys, and output means for synthesizing the musical tone signals from the musical tone control means thereby to provide a musical tone.

The digital electronic musical instrument of the above-mentioned structure is a compact system and yet can produce musical tones which vary delicately. The musical tone control means may be constituted by the identical circuits. In particular, if they are constituted each by the same LSI chip, the musical instrument becomes simple. In addition, since a different musical tone data can be preset in each musical tone control means, a variety of combinations of musical tones are possible, thus successfully providing various musical tones which are rich and pleasant.

Suppose the digital electronic musical instrument is provided with two musical tone control means. If the two musical tone control means are so designed as to start generating musical tones with a time lag, the musical instrument will produce a rich musical tone which delicately grows particularly right after it has been generated. If a musical tone data representing a tone with vibrato and a musical tone data representing a tone without vibrato are present in the two musical tone control means, respectively, the musical instrument will produce a musical tone with a delicately changing pitch. Further, each musical tone control means can control the volume increase and decrease of a musical tone, independently of the other. That is, the musical tone control means can independently achieve a volume envelope control. Thus, if the two musical tone control means are so designed to control volume envelope according to a data representing consonant volume variation and a data representing vowel volume variation, respectively, the musical instrument will easily produce a musical tone the volume of which changes delicately.

DETAILED DESCRIPTION

Figure 1:
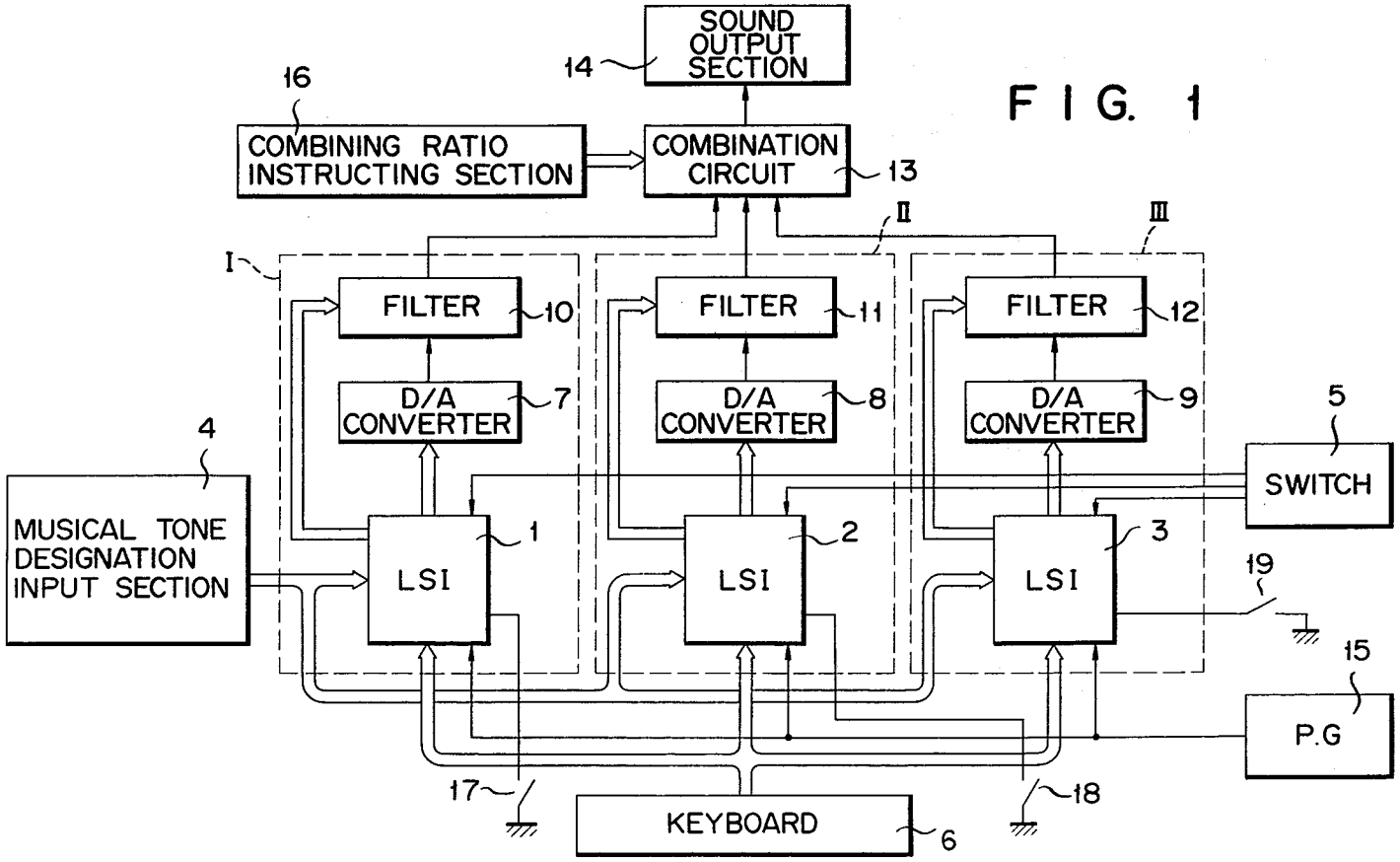
FIG. 1 is a block diagram of a digital electronic musical instrument according to this invention.

As shown in FIG. 1, a digital electronic musical instrument according to this invention is provided with three digital musical tone producing units 1, 2 and 3. The units 1, 2 and 3 are constituted by LSI (large scale integration semiconductor integrated circuit) chips of the same digital circuit arrangement. Each musical tone producing unit comprises a pitch-clock generating section, a waveform generating section, a volume envelope generating section, a section for controlling the generation of various effect tones, a rising-up time control section and the like—all being logic circuits packed in an LSI chip.

The musical tone producing units 1, 2 and 3 are connected to musical tone designation switches which constitute a musical tone designation input section 4. They are connected also to a changeover switch 5. The switch 5 is operated to designate any of the musical tone producing units 1, 2 and 3. The switches of the input section 4 are selected so as to preset a desired musical tone data into the designated musical tone producing unit. In this way desired musical tone data are present in the musical tone producing units 1, 2 and 3, by operating the switches of the musical tone designation input section 4.

The musical instrument further comprises a keyboard 6. The keyboard 6 includes, for example, 48 performance keys (4 octaves, 12 scales). When any one of the performance keys is depressed, a corresponding key code signal is supplied to all the musical tone producing units 1, 2 and 3 at the same time. Thus, upon operation of a single performance key the musical tone producing units 1, 2 and 3 produce musical tone signals. The musical tone signal from the unit 1 is supplied via a D/A (digital-analog) converter 8 and a filter 10 to a combination circuit 13. Similarly, the musical tone signal from the unit 2 is supplied via a D/A converter 8 and a filter 11 to the combination circuit 13, and the musical tone signal from the unit 3 via a D/A converter 9 and a filter 12 to the combination circuit 13. They are combined by the circuit 13, whereby a musical tone is generated by a sound output section 14 which has a loudspeaker.

The LSI 1, D/A converter 7 and filter 10 constitute a first musical tone control section I. The LSI 2, D/A converter 8 and filter 11 constitute a second musical tone control section II. The LSI 3, D/A converter 9 and filter 12 constitute the third musical tone control section III. That is the musical instrument is provided with three musical tone control sections I, II and III.

The musical instrument further comprises a pulse generator 15 (hereinafter abbreviated as "PG"). It supplies output pulses to the musical tone producing units 1, 2 and 3, so that the units 1, 2 and 3 are operated in synchronism. Further provided is a combining ratio instructing section 16 which determines the combining ratio of the musical tone signals from the musical tone control sections I, II and III, for instance 2:3:1. Further there are provided switches 17, 18 and 19 which designate, as will later be described, vibrato. Though not shown in FIG. 1, each musical tone control section is provided with a power source.

Figure 2A:
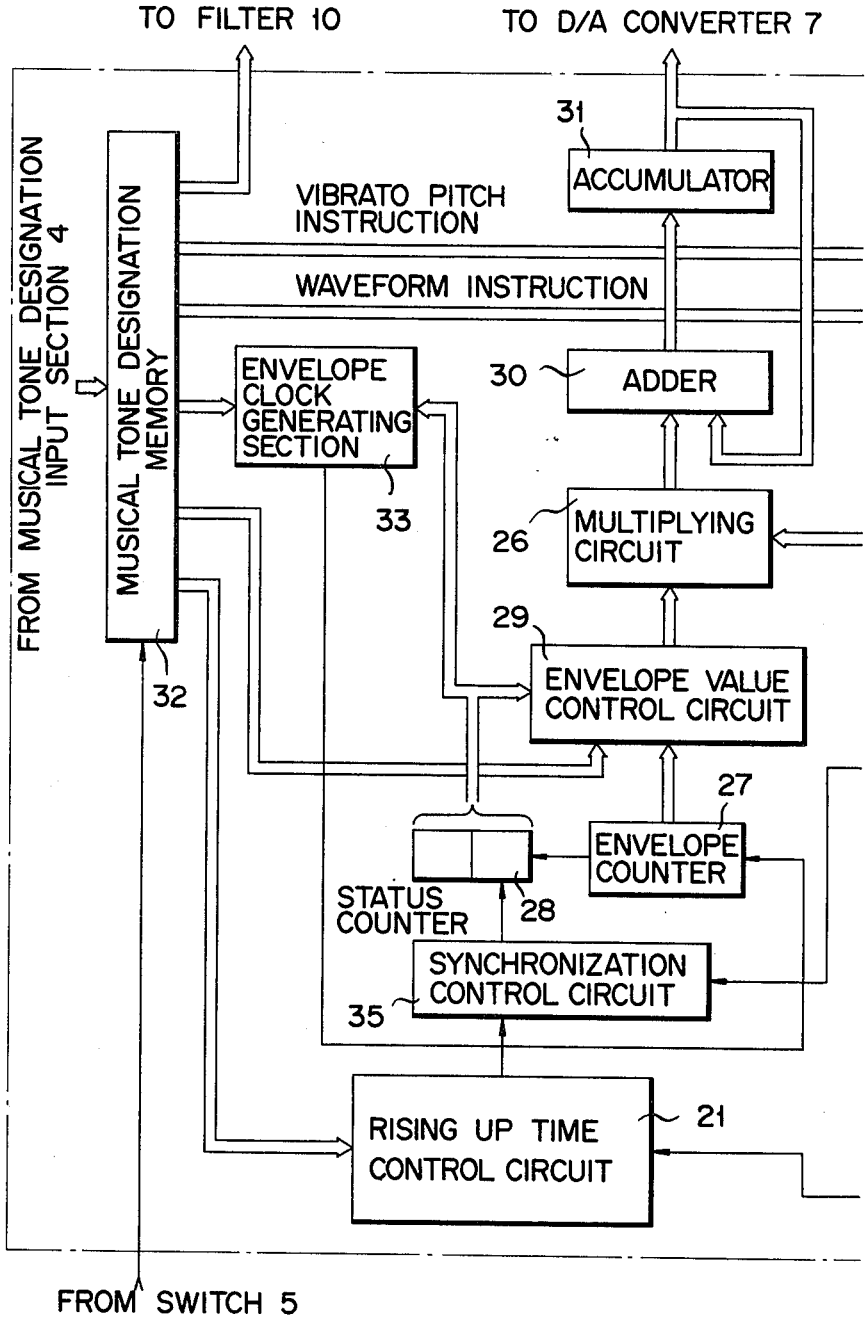
FIGS. 2A and 2B show a block circuit diagram of each of the musical tone producing units shown in FIG. 1.
Figure 2B:
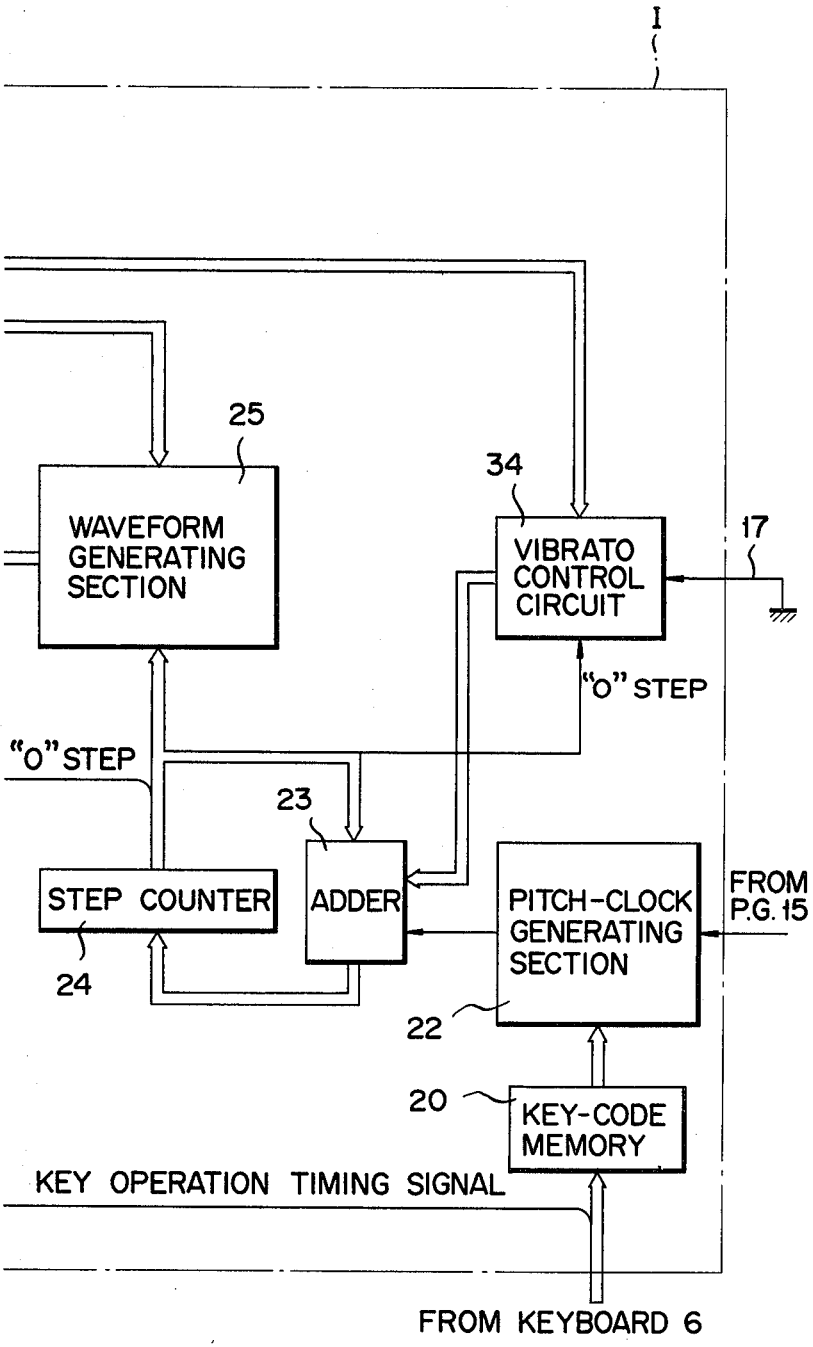

FIGS. 2A, 2B show the musical tone producing unit 1 more in detail. Needless to say, the other musical tone producing units 2 and 3 are of the same structure as shown in FIGS. 2A and 2B.

In the musical tone generating unit 1, a key code signal generated upon depression of one of the performance keys of the keyboard 6 is stored into a key code memory 20. At the same time a key operation timing signal is supplied to a rising-up time control circuit 21. From the memory 20 the key code signal is supplied to a pitch-clock generating section 22. The pitch-clock generating section 22 produces, upon receipt of a reference pulse from the PG 15, a pitch-clock signal of a frequency corresponding to the key code signal. That is, it delivers a pitch-clock signal whose frequency correspond to the performance key depressed. The pitch-clock signal is supplied to an adder 23 as "+1" signal. The output of the adder 23 is supplied to a step counter 24. Every time it receives an output of the adder 23, the step counter 24 has its count increased by "1". The step counter 24 is, for example, a 5-bit 32-scale binary counter. Its count is supplied to a waveform generating section 25. The waveform generating section 25 reads one musical tone waveform in 32 steps, step by step as the count of the counter 24 increases.

The waveform generating section 25 comprises a semiconductor memory which stores one musical tone waveform or an ROM (read only memory) which stores digital data each representing the amplitude of a 1/32 part of a musical tone waveform. Instead, the section 25 may store various musical tone waveforms, one of which is selected according to a waveform instruction as will later be described. More specifically, each waveform is split into 32 parts, and these 32 parts are read out in the form of 32 waveform signals as the count of the step counter 24 increases. The waveform signals are supplied to a multiplying circuit 26.

Figure 3:
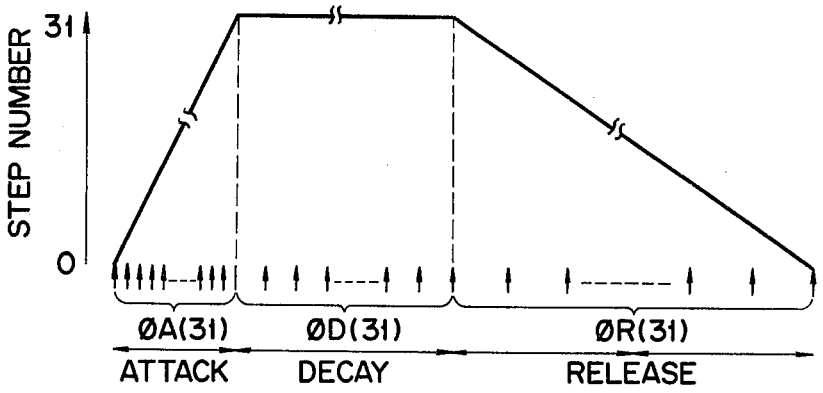
FIG. 3 is a graph showing the volume envelope which is controlled by the musical tone producing units shown in FIGS. 2A and 2B.

The musical tone generating unit 1 further comprises an envelope counter 27 for controlling a musical tone volume. It is constituted by, for example, 5-bit 32-scale counter and counts envelope clock signals supplied to it. The envelope clock signals define such an envelope as illustrated in FIG. 3. The envelope counter 27 first receives 31 clock signals $\phi_A$ which define an attack phase of the envelope and which are generated at regular intervals, then 31 clock signals $\phi_D$ which define a decay phase of the envelope and which are generated at longer regular intervals, and finally 31 clock signals $\phi_R$ which define a release phase of the envelope and which are generated at regular still longer intervals. A carry signal from the envelope counter 27 is supplied to a status counter 28, the count of which shows the attack, decay or release phase of the envelope shown in FIG. 3. More precisely, the count "00" shows a clear phase, count "10"0 the attack phase, count "01" the decay phase, and count "11" the release phase. The output signals of the envelope counter 27 and the status counter 28 are supplied to an envelope value control circuit 29.

So long as the count of the status counter 28 remains "00", the count of the envelope counter 27 is not supplied to the multiplication circuit 26 through the envelope value control circuit 29. While the count of the counter 28 is "10", the count of the counter 27 is supplied to the multiplying circuit 26. While the count of the counter 28 is "01", a count "31" is supplied to the multiplying circuit 26 whatever count the envelope counter 27 may have. While the count of the counter 27 is "11", the complement of the count of the counter 27 is supplied to the multiplying circuit 26, whereby a count of the counter 27 which might be obtained by down-counting is supplied to the multiplying circuit 26. In the multiplying circuit 26 the output of the waveform generating section 26 is multiplied by the output of the envelope value control circuit 29. The product is supplied via an adder 30 to an accumulator 31. The output of the accumulator 31 is fed back to the adder 30. That is, the amplitudes of the parts of an waveform, which have been detected by the waveform generating section 25, are multiplied by the envelope control value supplied from the envelope value control circuit 29. As a result, the output of the accumulator 31 represents a volume control value as well as a waveform of a musical tone.

The musical tone producing unit 1 further comprises a musical tone designation memory 32, which is connected to the aforementioned musical tone designation input section 4. The memory 32 stores a musical tone data which has been fed by operating one of the switches of the musical tone designation input section 4. The memory 32 is constituted by, for example, an RAM (random access memory) and stores a musical tone data if the musical tone generating unit 1 is designated by the changeover switch 5.

The musical tone designation input section 4 comprises a group of switches (not shown). These switches are operated to provide a waveform instruction for designating one of various waveforms such as a triangular waveform, a sawtooth waveform and a rectangular waveform, and instruction for selecting the rate at which clock signals $\phi_A$, $\phi_D$ or $\phi_R$ are generated, an instruction for selecting an envelope curve, an instruction for selecting a rising-up time, a vibrato-pitch instruction and an instruction for selecting a filter. Thus, the musical tone designation memory 32 supplies a waveform instruction to the waveform generating section 25, a signal representing the rate at which clock signals $\phi_A$, $\phi_D$ or $\phi_R$ are generated, to the envelope counter 27 through an envelope clock generating section 33, an envelope curve selecting instruction to the envelope value control circuit 29 and a rising-up time selecting instruction to the rising-up time control circuit 21. Further, the memory 32 supplies a vibrato-pitch instruction to a vibrato control circuit 34, which will later be described in detail. Still further, the memory 32 supplies a binary coded filter control signal to the filter 10.

The rising-up time control circuit 21 controls the rising-up time of the envelope. That is, it determines whether the count of the status counter 28 should be changed to "10" to put the counter 28 into "attack state" upon receipt of a key operation timing signal or some time after the receipt of the key operation timing signal. The output signal of the circuit 21 is supplied to the status counter 28 via a synchronization control circuit 35 when the count of the step counter 24 is "0", thereby bringing the status counter 28 into an attack state.

Figure 4:
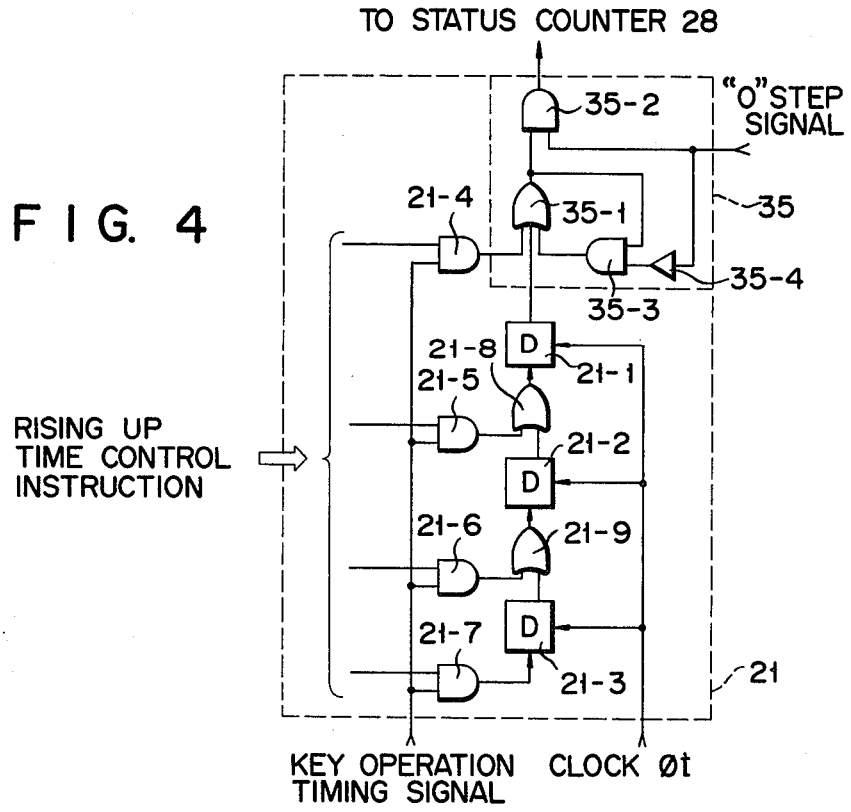
FIG. 4 is a circuit diagram of the signal-rising control circuit of the musical tone producing unit shown in FIGS. 2A and 2B.

The rising-up time control circuit 21 and the synchronization control circuit 35 are constituted as illustrated in detail in FIG. 4. The circuit 21 comprises delay circuits 21-1, 21-2 and 21-3 which are responsive to a clock signal $\phi_t$ and AND gates 21-4, 21-5, 21-6 and 21-7 which receive at one input a key operation timing signal. These AND gates receive at the other end a rising-up time control instruction from the musical tone designation memory 32, which has been supplied to the memory 32 from the musical tone designation input section 4 and which is to select one of rising-up delay times. More specifically, the AND gate 21-4 serves to provide no delay time, the AND gate 21-5 a delay time of t, the AND gate 21-6 a delay time of 2t and the AND gate 21-7 a delay time of 3t. The output signal of the AND gate 21-5 and the output signal of the delay circuit 21-2 are supplied to the delay circuit 21-1 through an OR gate 21-8. The output signal of the AND gate 21-6 and the output signal of the delay circuit 21-3 are supplied to the delay circuit 21-2 through an OR gate 21-9. The output signal of the AND gate 21-7 is supplied to the delay circuit 21-3. The synchronization control circuit 35 is constituted by a three-input OR gate 35-1, AND gates 35-2 and 35-3 and an inverter 35-4. The output signal of the delay circuit 21-1 and the output signal of the AND gate 21-4 are supplied to the two input terminals of the OR gate 35-1, respectively. Through the OR gate 35-1 they are supplied to one input terminal of the AND gate 35-2 and to one input terminal of the AND gate 35-3. Thus, the output signals of the delay circuit 21-1 and the AND gate 21-4 are held in the AND gate 35-3. The other input terminal of the AND gate 35-2 receives a "0" step signal from the step counter 24. The "0" step signal is inverted by the inverter 35-4 into a "1" signal, which is supplied to the other input terminal of the AND gate 35-3.

The key operation timing signal is therefore held in the AND gate 35-3 for the period of time which is defined by the rising-up time control signal instruction. When the count of the step counter 24 is "0", the AND gate 35-2 is closed, whereby the AND gate 35-2 delivers a "10" signal which will bring the status counter 28 into an attack state. The moment the AND gate 35-2 delivers the output signal "10", the AND gate 35-3 is closed and the OR gate 35-1 ceases to produce an output signal. Thus, the signal "10" is no longer held in the AND gate 35-3.

Suppose a rising-up delay time t is designated in the musical tone control section I but not in the musical tone control section II or III and that the same envelope curve is preset in all the musical tone control sections I, II and III. When any one of the performance keys of the keyboard 6 is depressed, the key code signal corresponding to the depressed key is supplied to the key code memories 20 of all the musical tone producing units 1, 2 and 3, and at the same time a key operation timing signal is supplied to the rising-up time control circuit 21 of the musical tone producing units 1, 2 and 3. In the musical tone producing units 2 and 3, wherein no rising-up delay time is designated, the AND gate 21-4 instantaneously produces an output signal "10", which is supplied to the status counter 28 via the OR gate 35-1 and the AND gate 35-2 and brings the status counter 28 into an attack state. Consequently, each of the musical tone producing units 2 and 3 generates a musical tone signal according to such a volume control value delivered from the envelope control circuit 29 as is illustrated by line P in FIG. 5. By contrast, in the musical tone producing unit 1 wherein the rising-up delay time t is designated, the key operation timing signal is supplied to the AND gate 21-5 and the OR gate 21-8 and delivered from the delay circuit 21-1 with a time lag of t. The output signal of the delay circuit 21-1 is therefore supplied to the AND gate 35-3 via the OR gate 35-1 and is held in the AND gate 53-3 after the period of time t has elapsed. Upon receipt of a "0" step signal from the step counter 24 the AND gate 35-2 supplies an output "10" to the status counter 28, thus bringing the counter 28 into an attack state. Consequently, the musical tone producing unit 1 generates a musical tone signal according to such a volume control value delivered from the envelope control circuit 29 as is illustrated by chain line q(t) in FIG. 5, when the period of time t lapses after the musical tone producing units 2 and 3 have produced the musical tone signals.

If the musical tone control sections I, II and III provide musical tone signals at different times in the above-mentioned manner, these musical tone signals are synthesized with a time lag among them, thereby producing a musical tone which delicately grows and decays two times with a little time lag. Since the musical tone thus produced delicately grows, it successfully simulates a musical tone of a piano or a stringed instrument and is effectively used in block chord play.

Figure 5:
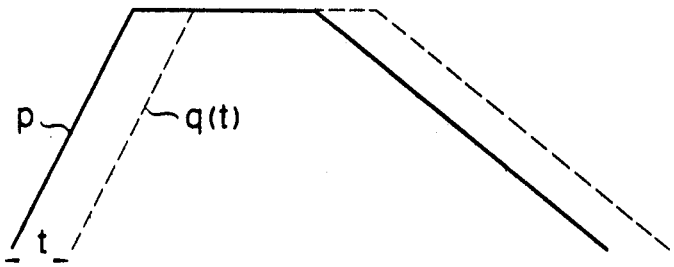
FIGS. 5 to 7 illustrate volume envelopes which are controlled by the signal-rising control circuit shown in FIG. 4.
Figure 6:
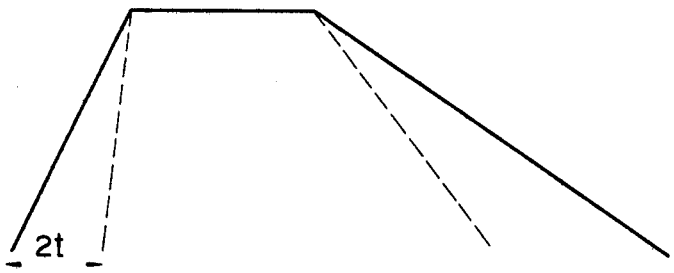
Figure 7:
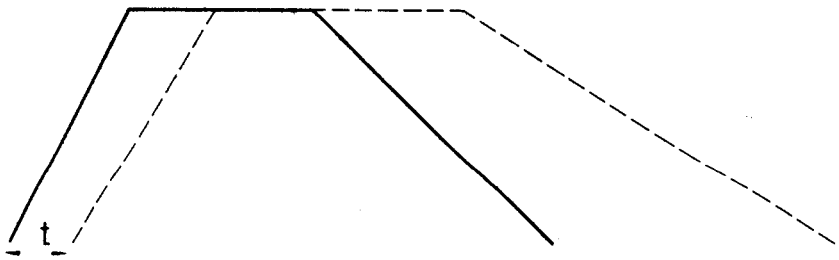

FIG. 5 illustrates how to synthesize musical tone signals of the identical volume envelope with a time lag of t. Instead, musical tone signals of different volume envelopes may be synthesized with a time lag of 2t as shown in FIG. 6 or with a time lag of t as shown in FIG. 7. That is, the musical tone signals of various envelopes can by synthesized with various time lags to provide a rich and pleasant musical tone. This can be effected merely by presetting desired musical tone data in the musical tone control sections I, II and III.

The vibrato control circuit 34 shown in FIG. 2B receives a vibrato pitch instruction from the musical tone designation memory 32. The vibrato pitch instruction designates one of various vibrato pitches, e.g. pitch 1, pitch 2 and pitch 3. A vibrato pitch signal consisting of pulses, the number of which corresponds to the designated vibrato pitch, is supplied from the circuit 34 to adder 23 every time the circuit 34 receives a "0" step signal from the step counter 24 so long as the vibration designation switch 17 is kept closed. Unless a vibrato pitch signal is supplied from the vibrato control circuit 34, the adder keeps receiving pitch-clock signals from the pitch-clock generating section 22, and the step counter 24 keeps counting the output signals of the adder 23. But, when a vibrato pitch signal is produced by the circuit 34, it is added to the step counter 24 via the adder 23. Since the vibrato pitch signal or a few pulses are added to the step counter 24 the moment the count of the counter is "0", the step counter 24 generates output signals at slightly shorter intervals than when the switch 17 is opened. Musical tone signals representing a tone with vibrato will therefore be delivered from the musical tone control section 1 as long as the vibration designation switch 17 is kept closed. If neither the switch 18 nor 19 is closed, the musical tone control sections II and III produce musical tone signals representing tones without vibrato. As a result, the musical tone which is produced by synthesizing these musical tone signals from the musical tone control sections I, II and III will undergo an effective tone color change and is thus a rich and pleasant musical tone.

Figure 8:
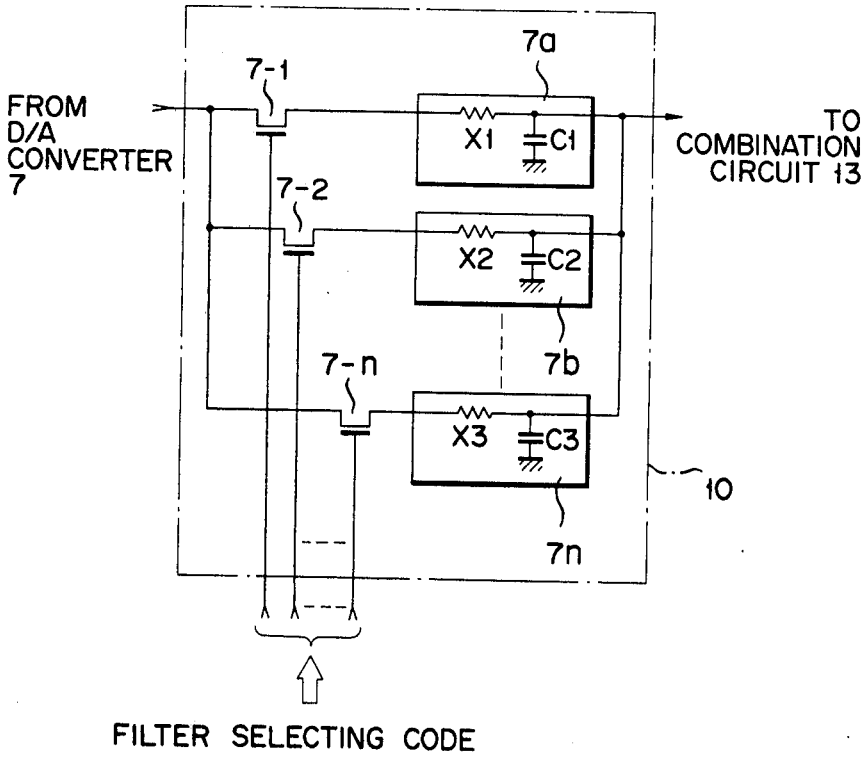
FIG. 8 is a circuit diagram of the filter shown in FIG. 1.

The filter 10 of the musical tone control section I is constituted as shown in detail in FIG. 8. Needless to say, the filters 11 and 12 of the musical tone control sections II and III are of the same structure as shown in FIG. 8.

The filter 10 comprises analog switches 7-1, 7-2, . . . 7-n for receiving musical tone signals from the D/A converter 7. One of these analog switches is selected according to a filter selection code which corresponds to a musical tone to be produced and which is supplied from the musical tone designation memory 32. The filter 10 further comprises filter circuits *7a, 7b, . . . 7n* which are designed to filter signals of different ranges of frequency and which are connected to the analog switches 7-1, 7-2, . . . 7-n, respectively. The output of the selected analog switch is supplied to the corresponding filter circuit. In this way, one of the filters *7a, 7b, . . . 7n* is selected in accordance with the musical tone data which have been preset in the musical tone producing unit 1 by the musical tone designation input section 4, whereby a musical tone with a desired color is produced.

As mentioned above, the musical tone producing units 1, 2 and 3 are constituted each by an identical LSI chip. Their musical tone designation memories 32 can store different musical tone data which are supplied from the musical tone designation input section 4. Thus, each musical tone producing unit can produce a musical tone signal in accordance with a waveform instruction, an envelope curve selecting instruction, a rising-up time selecting instruction, a filter selecting instruction and the like. Every time one of the performance keys of the keyboard 6 is depressed, the loudspeaker of the sound output section 14 gives forth a musical tone, a combination of three musical tone signals coming from the musical tone producing units 1, 2 and 3 through the D/A converters 7, 8 and 9 and the filters 10, 11 and 12, respectively. The three musical tone control sections I, II and III, which constitute a simple circuit system and which provide different musical tone signals, cooperate to produce a large variety of musical tones. Since different volume envelopes can be preset in the musical tone producing units 1, 2 and 3, the sound output section 14 produces a musical tone which delicately varies particularly as it grows. More specifically, since each musical tone producing unit may store such a volume envelope as represents a volume variation of a voiced sound, typically a vowel or of a voiceless sound, e.g. a fricative consonant and an explosive consonant, the musical tone produced by the sound output section 14 varies as delicately as does the musical tone produced by a conventional musical instrument.

In the above-described embodiment three LSIs are used. Instead, two LSIs or four or more LSIs may be provided. The circuit structure of the musical tone producing units 1, 2 and 3 is not limited to the structure which has been described above with reference to FIGS. 2A and 2B. Various modifications are of course possible within the scope of this invention.

What is claimed is:

1. A digital electronic musical instrument comprising:

a keyboard including a set of performance keys;

a plurality of musical tone generating means, each of said musical tone generating means being of substantially the same circuit structure, and each of said musical tone generating means being constituted by one LSI chip;

each of said musical tone generating means including a waveform generating means for digitally generating a waveform signal; and a volume envelope controlling means coupled to said waveform generating means for digitally controlling a volume envelope and for generating an envelope-controlled waveform signal;

means coupled to said plurality of musical tone generating means for operating all of the musical tone generating means upon operation of said performance keys;

a plurality of digital-analog converter means, coupled to each of said musical tone generating means correspondingly, for converting said envelope-controlled waveform signal into an analog signal;

filter means coupled to said plurality of digital-analog converter means for filtering said analog signal; and output means coupled to said filter means for synthesizing the musical tone signals from said filter means to thereby provide a musical tone.

2. A digital electronic musical instrument according to claim 1, wherein each of said musical tone generating means has means for digitally delaying the start of generating a musical tone by a desired period of time.

3. A digital electronic musical instrument according to claim 2, wherein two musical tone generating means are provided.

4. A digital electronic musical instrument according to claim 3, wherein one of said musical tone generating means has means for digitally storing data representing a consonant volume variation, and the other musical tone generating means has means for digitally storing data representing vowel volume variation.

5. A digital electronic musical instrument according to claim 1, wherein two musical tone generating means are provided, and further comprising means in one of said musical tone generating means to generate a musical tone signal representing a tone with vibrato.

6. A digital electronic musical instrument according to claim 1, further comprising means for designating a ratio at which the musical tone signals delivered from said musical tone generating means are synthesized.

7. A digital electronic musical instrument according to claim 1, wherein said filter means includes means in which there is preset a binary code to define the frequency range of the filter means.

* * * * *

UNITED STATES PATENT AND TRADEMARK OFFICE

CERTIFICATE OF CORRECTION

PATENT NO. : 4,419,919

DATED : December 13, 1983

INVENTOR(S) : Toshio KASHIO

It is certified that error appears in the above-identified patent and that said Letters Patent is hereby corrected as shown below:

COLUMN 8 (claim 6), line 63, after "said" change "musical tone generating" to --filter--.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*